US006194027B1

(12) United States Patent
Mauchle

(10) Patent No.: US 6,194,027 B1
(45) Date of Patent: Feb. 27, 2001

(54) METHOD AND EQUIPMENT FOR POWDER SPRAY COATING

(75) Inventor: Felix Mauchle, Abtwil (CH)

(73) Assignee: ITW Gema AG, Schweiz (CH)

( * ) Notice: Subject to any disclaimer, the term of this patent is extended or adjusted under 35 U.S.C. 154(b) by 0 days.

(21) Appl. No.: 09/184,356

(22) Filed: Nov. 2, 1998

(30) Foreign Application Priority Data

Nov. 3, 1997 (DE) ..... 197 48 376

(51) Int. Cl.[7] ..... B05D 1/02

(52) U.S. Cl. ..... 427/180; 427/195; 427/421; 427/424; 427/477; 239/106

(58) Field of Search ..... 427/475, 477, 427/479, 480, 486, 421, 424, 195, 180; 406/109, 151; 118/681, 627, 629, 631, 634, 308; 239/99, 106, 112, 120

(56) References Cited

U.S. PATENT DOCUMENTS

| | | | |
|---|---|---|---|
| 3,625,404 | | 12/1971 | Probst . |
| 3,746,254 | | 7/1973 | Duncan et al. . |
| 4,302,481 | | 11/1981 | Ribnitz et al. . |
| 4,314,669 | | 2/1982 | Moos . |
| 4,600,603 | | 7/1986 | Mulder . |
| 4,824,295 | * | 4/1989 | Sharpless . |
| 5,131,350 | | 7/1992 | Buschor . |
| 5,454,256 | | 10/1995 | Gimben et al. . |
| 5,704,957 | | 1/1998 | Rutz . |
| 5,765,971 | | 6/1998 | Rutz . |

FOREIGN PATENT DOCUMENTS

| | | |
|---|---|---|
| 35 42 710 | 6/1987 | (DE) . |
| 195 19 092 | 11/1995 | (DE) . |
| 44 19 987 | 2/1996 | (DE) . |
| 195 48 607 | 6/1997 | (DE) . |
| 196 13 967 | 10/1997 | (DE) . |
| 0 204 437 | 12/1986 | (EP) . |
| 0 412 289 | 2/1991 | (EP) . |
| 0 629 451 | 12/1994 | (EP) . |
| 0 689 875 | 1/1996 | (EP) . |
| 0 718 043 | 6/1996 | (EP) . |
| 0 763 385 | 3/1997 | (EP) . |
| 0 769 327 | 4/1997 | (EP) . |
| 94/13405 | 6/1994 | (WO) . |
| 94/22589 | 10/1994 | (WO) . |

OTHER PUBLICATIONS

European Search Report, Feb. 15, 1999.
European Search Report, Feb. 15, 1999.
German Search Report, Aug. 11, 1999.

* cited by examiner

*Primary Examiner*—Fred J. Parker
(74) *Attorney, Agent, or Firm*—Lowe Hauptman Gopstein Gilman & Berner

(57) ABSTRACT

A method for powder spray-coating objects utilizes pneumatic conveyance of powder from an injector to a spraying system having a spray coating zone through which objects are consecutively conveyed in an automated system. Power conveyance is interrupted between the consecutive objects as object gaps enter the spray coating zone while the conveying air flow is maintained by injection of controlling air into a vacuum zone of the injector which reduces the injector vacuum to a degree causing interruption of powder conveyance. Flushing compressed air may be injected between the injector and the spray device of the spraying system to automatically flush powder to maintain system integrity. Equipment for powder spray coating of objects utilizing the above method is also disclosed.

12 Claims, 2 Drawing Sheets

METHOD AND EQUIPMENT FOR POWDER SPRAY COATING

TECHNICAL FIELD

The invention concerns a method and equipment for powder-spray coating of objects.

BACKGROUND ART

Powder-coating equipment is known from the European patent application EP 0,718,043 A1 wherein a conveying airflow generates a partial vacuum in a vacuum zone of an injector and thereby sucks powder out of a container and moves it into a powder line. Downstream of the vacuum zone, supplemental air is supplied through a supplemental-air intake to the flow of conveying air and powder in order to implement a predetermined flow of total air.

European patent 0,412,289 B1 discloses electrostatic powder coating equipment having an injector fed with conveying and with supplemental air. The supplemental air can be conveyed as control air into the injector vacuum zone.

German Offenlegungsschrift DE 44 19 987 A1 discloses an injector/conveyor system to move coating powder, having a suction pipe connected to the injector vacuum zone and running downward into a powder container, whereby powder is sucked from this container into the vacuum zone. Compensating air is fed to the suction pipe end located remote from the vacuum zone to compensate for fluctuations in the suction amplitude. As shown by U.S. Pat. No. 3,746,254, the powder container can also be mounted above the injector vacuum zone, instead of underneath, whereby the powder suction aperture is located above the vacuum zone.

European patent application EP 0,769,327 A1 discloses powder coating equipment wherein the injector is located at the lower end of a pipe which is immersible into a powder container in order to convey powder from it.

The present invention encompasses all the above embodiments and is not restricted to any particular embodiment.

It is known with respect to powder coating equipment to cleanse the powder line of deposited powder particles from time to time, usually with a hose and spray apparatus, This procedure is required to preclude unchecked discharge of deposited, old powder particles which would interfere with coating the surface of an object. Ordinarily, compressed air is connected to the injector to flush the powder hose and the spray apparatus by being blown through the injector and the powder hose and spray apparatus. This known flushing procedure incurs a drawback in that the flushing air not only flows to the spray apparatus, but also divides inside the injector into other lines communicating with it. The known systems suffer from a further drawback in that the powder coating operation must be stopped when cleansing with flushing air and that later the conveying air and any supplemental air must be readjusted to the desired pressure levels and rates of conveyed powder. While powder deposits in the powder hose can be markedly reduced by using a hose made of an appropriate material, nevertheless, when dealing with great hose lengths, the quantity of deposited powder particles remains comparatively high.

The object of the invention is to achieve very high quality coating of a large series of objects without interfering with or interrupting this mass production on account of cleansing procedures or adjustments of the spray coating equipment. Illustratively, the invention enables mass-coating of automobile bodies with a surface quality as good as presently offered by liquid enamel. Accordingly, the object of the present invention is to place the highest requirements on powder coating quality regarding object adhesion, sealing of the powder coating after being baked onto the object, extreme uniformity and smoothness in the coating. The related method and equipment shall offer very high reliability in permanent operation.

SUMMARY OF THE INVENTION

A method for powder spray-coating objects utilizes pneumatic conveyance of powder from an injector to a spraying system having a spray coating zone through which objects are consecutively conveyed in an automated system. Power conveyance is interrupted between the consecutive objects as object gaps enter the spray coating zone while the conveying air flow is maintained by injection of controlling air into a vacuum zone of the injector which reduces the injector vacuum to a degree causing interruption of powder conveyance. Flushing compressed air may be injected between the injector and the spray device of the spraying system to automatically flush powder to maintain system integrity. Equipment for powder spray coating of objects utilizing the above method is also disclosed.

BEST MODE FOR CARRYING OUT THE INVENTION

Figure 1:
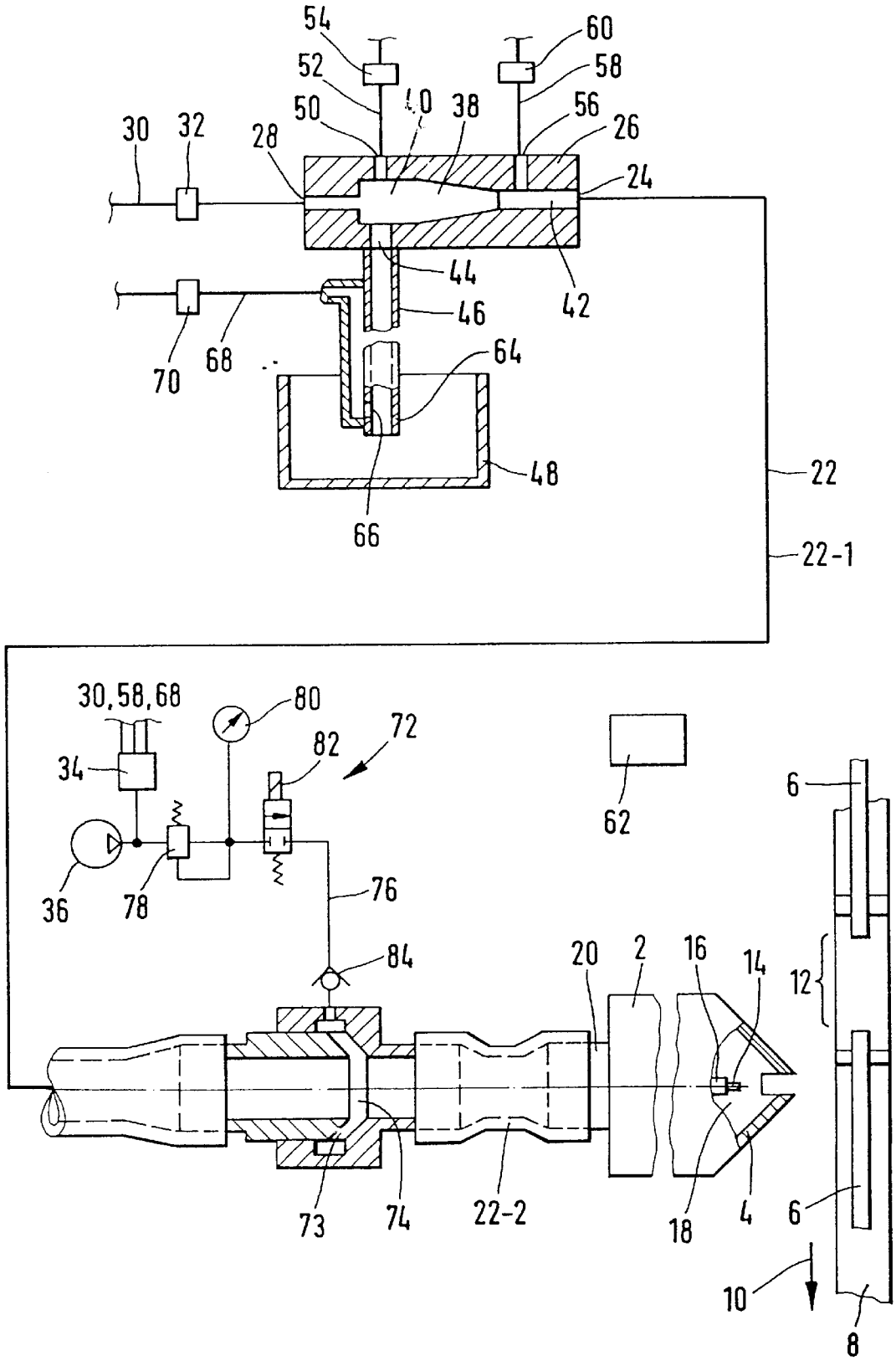
FIG. 1 schematically depicts powder coating equipment of the invention (not to scale)

The powder spray coating equipment shown in FIG. 1 contains a spraying system 2 comprising a spraying device 4 to spray coating powder on objects 6, for instance automobile bodies, that are continuously conveyed along a conveyorized system 8 in the direction of an arrow 10, transversely to and at the front side of the spraying device 4, whereby these objects enter the spray coating zone of the spraying device. The objects 6 are separated from one another by a slight distance or gap 12. The spraying device 4 may be a spray nozzle as shown in FIG. 1 or a rotating unit, for instance a spray bell. The spraying device 4 is fitted with one or more high-voltage electrodes 14 to electrostatically charge the powder. The electrode 14 may project from a support tube 16 from which air passes over the electrode 14 to prevent powder particles from being deposited thereon. The high voltage for the electrode 14 may be generated by a high-voltage source mounted inside or outside the spraying system 2. The spraying device 4 is located at the downstream end of a powder duct 18 of the spraying system 2 of which the upstream opening 20 communicates through a powder line 22 with the powder outlet 24 of an injector 26. A conveying-air intake 28 is axially opposite the powder outlet 24 and is connected by a conveying-air line 30 containing a pressure regulator 32 and by a manifold 34 to a pressure source 36. In the vicinity of the conveying-air intake 28, an injector duct 38 comprises a vacuum zone 40, hereafter called vacuum zone 40, having a widened diameter and a reduced diameter powder-outlet duct 42. A powder suction tube 46 runs from the vacuum zone 40 through a powder-intake aperture 44 into a powder container 48, so that the conveying-air flow of the conveying-air line 30 causes a partial pressure, hereafter vacuum, in the vacuum zone 40, to suck powder out of the powder container 48 and convey it through the powder line 22 to the spraying system 2 which sprays the powder in the form of a spray cloud or spray cone onto the objects 6.

A controlling-air intake 50 communicates with the vacuum zone 40 of the injector 26 and is connected by a controlling-air line 52 containing a pressure regulator 54 and by the manifold 34 to the compressed-air source 36. By introducing controlling air into the vacuum zone 40, the vacuum therein can be reduced to an extent, or eliminated, such that the powder conveyance from the container 48 is interrupted when the conveying air of the conveying-air line 32 flows at a constant rate through the injector 26.

A supplemental-air intake 56 communicates with the powder-outlet duct 42 and is connected by a supplemental-air line 58 optionally containing a pressure regulator 60 and by the manifold 34 to the pressure source 36. Together with the conveying air, the supplemental air provides a total air flow which prevents powder-flow pulses and substantial powder deposits in the powder line 22. The total air flow might also be controlled using the controlling air from the controlling-air line 52 instead of the supplemental air of the supplemental-air line 58, however, such a selection would be disadvantageous because the controlling air affects the vacuum effect in the vacuum zone 40 and hence the conveyor effect of the conveying air of the conveying-air line 30 and thereby the conveying air also would have to be changed if controlling air were used to compensate for changes in air flow in the powder line 22. For that reason, the invention provides that the controlling air of the controlling-air line 52 is used only to negate the vacuum in the vacuum zone 40 in order to thereby shut down the conveyance of powder rather than only reduce it. During this stoppage of powder conveyance, the invention provides that, while an object gap 12 is present in front of the spray device 4, the conveying air of the conveying-air line 30 and the supplemental air of the supplemental-air line 58 are fed unchanged to the injector 26 and to the powder line 22. Powder conveyance is turned ON again once the next object 6 is in front of the spray device 4 by shutting OFF the controlling air of the controlling-air line 52. The turning ON and OFF steps depend on conveyance rates and size of the objects 6 and is automated by a processor-controlled electronic control system 62. The following advantages are achieved: when turning OFF powder conveyance, the residual powder is still being moved out of the powder/air path (38, 42, 22, 2) and is sprayed by the spray device 4. As a result, when the powder conveyance is again turned ON, a powder impact is prevented and hence also coating defects on the object 6 to be coated next. Preferably, the control system 62 is programmed in such manner that powder conveyance shall not be turned OFF at the object gap 12, but shortly before the end of the object 6 that was just coated, whereby all the powder still present in the powder path shall still be deposited on this object without introducing coating defects. This procedure offers the further advantage of reducing powder loss, namely, powder not adhering to the objects 6.

The suction tube 26 is fitted with a compensating-air intake 66 at its lower end segment 64 away from the injector 26 to move compressed air acting as compensating air into the suction tube 46 in order to compensate for or to damp any pressure fluctuations. The compensating-air intake 66 is connected by a compensating-air line 68 optionally containing a pressure regulator 70 to the manifold 34 of the compressed-air source 36. The compensating air is supplied at constant pressure and constant flow both during powder conveyance and during pauses therein.

To keep the spraying system 2 and optionally also the powder line 22 clean, a flushing-air device 72 comprising at least one flushing-air intake 73 is provided. The flushing-air intake 73 is preferably situated at a site wherein the flow impedance to this flushing air in the air/powder path subtended by the powder line 22, the spraying system 2 and the injector 26 will be smaller in the downstream direction as far as through the spraying system 2 than in the upstream direction through the injector 26. As a result, the flushing air flows only toward the spray device 4 and then towards the objects 6, not in the opposite direction to the injector 26. Therefore the flushing-air intake 73 is located between the half length of the powder line 22 and the spray device 4, and in a modified embodiment, several such sites or flushing-air intakes may also be provided. The more appropriate the material of the powder line 22—which ordinarily is a hose—to preclude powder deposits inside it, the farther the flushing-air intake 73 can be shifted downstream toward the spray device 4. The powder path in the spraying system 2 may consist of a similar material to reduce deposits of powder particles. The spray device 4, even when of the same material, must be cleansed inside with flushing air because the powder particles not only slide along the inside surfaces of the spray device 4, but also impinge transversely on these inside surfaces. Accordingly, preferred embodiments provide that the at least one flushing-air intake 73 be mounted at a flushing-air supply site located between the half length of the powder line 22 and the intake 20 preferably at about 75% downstream from the upstream end of the powder line 22 or directly at the powder intake 20 of the spraying system 2, or, according to FIG. 2 of the drawings, inside the spraying system 2 at a short upstream distance from the spray device 4 in order that the flushing air shall impinge free of throttling on the inside surfaces of the spray device 4 and shall flush away any powder particles.

In the embodiment of FIG. 1, the powder line 22 is a hose divided into an upward hose segment 22-1 of more than half-length and a short hose segment 22-2 substantially shorter than half the hose length. The two hose segments 22-1 and 22-2 communicate with each other through the flushing-air intake 73 which comprises an annular slit nozzle 74. The flushing air flows from the slit nozzle 74 through the downstream hose segment 22-2 and then through the spraying system 2, none of this flushing air flowing in the opposite direction to the injector 26.

The flushing air is shut OFF during powder conveyance and is turned ON in the absence of powder conveyance either at each object gap 12 or only at one of several object gaps 12 in front of the spray device 4. In a preferred embodiment of the invention, the flushing air is not supplied as a permanent flow of compressed air, but rather in the form of at least one, preferably at least two, three or four of brief, consecutive pulses of compressed air. To generate these impulsive compressed-air pulses, the flushing-air intake 73 is connected, through a compressed-air line 76 containing, in sequence of flow, a pressure regulator 78, a pressure gauge 80 and a reversing valve 82, to the compressed-air source 36 or its manifold 34. Preferably, the reversing valve 82 is an electromagnetic or pneumatic two/two-way valve controlled by the electronic control 62. The flushing-air intake 73 is fitted with a backflow stop 84 which may be a filter to filtrate powder particles and/or a check valve opening only in the direction of flow of the flushing air toward the flushing-air intake 73 but which will close when the fluid pressure is in the opposite direction. The compressed air used as flushing air is fed to the flushing-air intake 73 preferably at a rate of 15 to 40 $Nm^3/h$ and a pressure up to a maximum of 6 bars, preferably up to 5 bars. The pressure of the flushing air is correspondingly adjustable at its regulator 78.

The flushing air can be turned ON either when all air hookups of the injector 26 are shut OFF or, in the preferred implementation, while all air hookups or at least the conveying air of the injector 26 remain ON. As a result and in this preferred implementation, while an object 6 to be coated is opposite the spray device 4, conveying air from the conveying-air line 30, supplemental air from the supplemental-air line 58 and compensating air from the compensating-air line 68 will flow through the spray device 4; when, however, an object gap 12 is opposite the spray device 4, and the powder conveyance is shut OFF due to the controlling-air supply from the controlling-air line 52, then the supplemental air of the supplemental-air line 58, the compensating air of the compensating-air line 68, and, during the cleansing phase, the flushing air from the flushing-air intake 73, will flow through the spray device 4. In a special mode of implementation, the flushing air already is turned ON when an end segment of an object 6 to be coated still remains in the spray zone of the spray device 4 in order that all the powder for the coating procedure be used for coating. The powder coating on the object 6 thereby remains unaffected in thickness or other features when the powder conveyance also is turned OFF shortly ahead of the end of the object 6 that was just coated on account of turning ON the controlling air of the controlling-air line 52 and being moved into the vacuum zone 40. The electronic control unit 62 assures time coordination of the diverse kinds of air.

Figure 2:
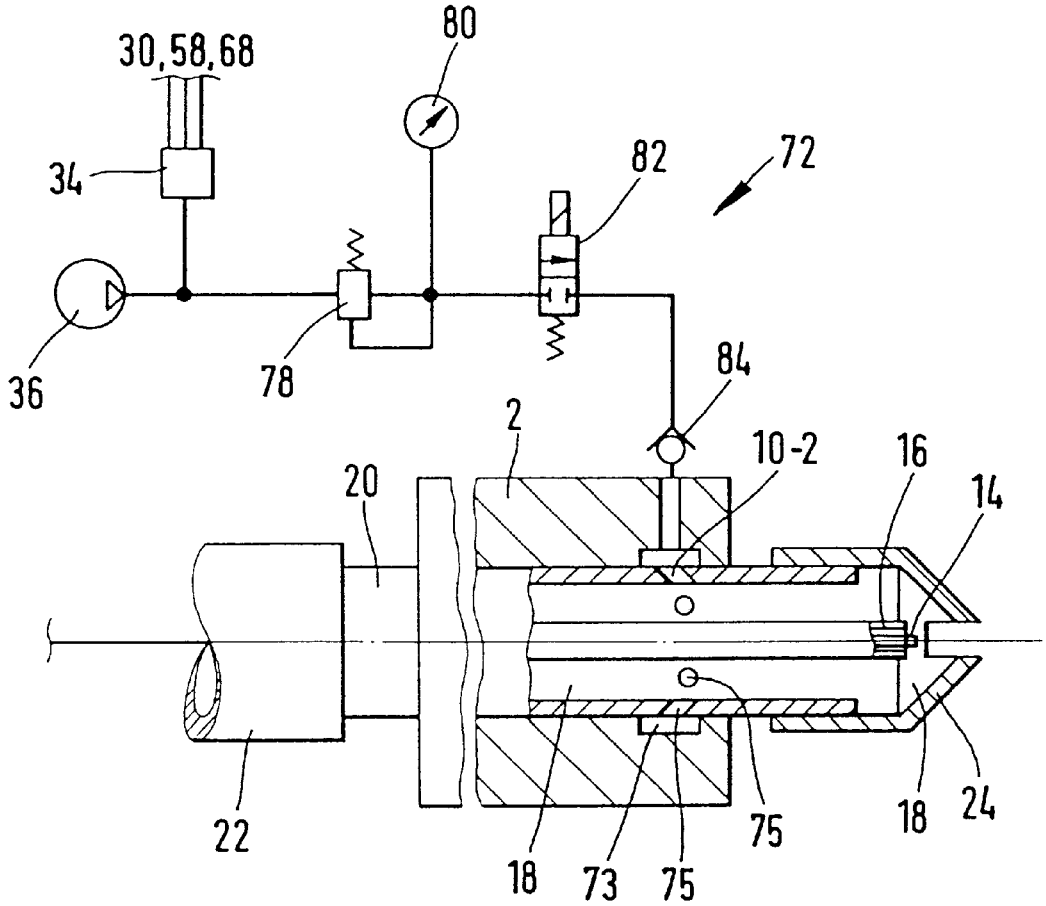
FIG. 2 shows part of a further embodiment of powder coating equipment of the invention in which the omitted part is identical with the pertinent part of FIG. 1.

In the embodiment of FIG. 1 the flushing-air intake 73 comprises at least one annular slit nozzle 74 enclosing the air/powder path to preclude supplying to this path excessive flushing air and without need for especially high pressure. In the embodiment of FIG. 2 the flushing-air intake 73 instead comprises a plurality of annular boreholes 75 issuing into the air/powder path. This embodiment achieves an effect similar to that obtained with an annular slit nozzle, however at a somewhat larger flow impedance. Preferably, both the annular slit nozzle 74 of FIG. 1 and the flushing-air boreholes 75 of FIG. 2 are arranged obliquely at an angle of about 45° relative to the direction of the air/powder flow.

What is claimed is:

1. A method of powder spray-coating objects, comprising the steps of:

pneumatically conveying of a powder from a container (48) through an injector (26) and a powder line (22) to a spraying system (2), using a conveying-air flow (30) moving through the injector (26) and generating a vacuum in a vacuum zone (40) of the injector, thereby sucking powder out of the container and conveying the powder through the powder line to the spraying system, automatically and consecutively moving the objects through a spray-coating zone of the spraying system (2), interrupting powder conveyance at object gaps (12) formed between consecutively moving objects (6) by inserting controlling air (52) guided into the vacuum zone (40) of the injector (26) to reduce the vacuum to a degree that powder conveyance is interrupted.

2. The method of claim 1, wherein the conveying-air flow is maintained during full periods of interruption of powder conveyance when one of the object gaps (12) is located in a spray-coating zone of the spraying system (2), and wherein an air/powder path extending from the injector (26) to the spray device (4) of the spraying system (2) is automatically flushed with flushing compressed air at a downstream segment of the spray device during an interruption of powder conveyance.

3. The method of claim 2, wherein powder conveyance is automatically turned ON by shutting OFF or correspondingly reducing the controlling air at an end of an object gap (12), and wherein all the above method steps are controlled by an electronic control unit (62) so that they automatically operate in coordinated manner.

4. Method as claimed in claim 3, wherein the flushing compressed air is turned ON automatically shortly before an object to be coated (6) leaves the spray-coating zone of the spraying system (2) such that flushing compressed air by means of the spraying system (2) continues to deposit remaining powder in the spraying system on the object (6) and thereby completes coating of the object.

5. Method as claimed in claim 4, wherein the flushing compressed air is supplied to the air/powder path at a rate of 15 to 40 $Nm^3/h$.

6. Method as claimed in claim 4, wherein the flushing compressed air is supplied in the form of compressed-air pulses of a pulse length less than 10 seconds with at least one compressed-air pulse per flushing.

7. Method as claimed in claim 6, wherein at least three flushing compressed air pulses are generated per flushing.

8. Method as claimed in claim 6, wherein the pulse length is in the range of 0.5 to 3.0 seconds.

9. Method as claimed in claim 3, wherein the flushing compressed air is supplied to the air/powder path at a pressure in the range of 2 to 5 bars.

10. Method as claimed in claim 3, wherein supplemental compressed air is supplied both during powder conveyance and during interruption of powder conveyance to the air/powder path at the injector (26) at a location downstream from the vacuum zone of said injector.

11. Method as claimed in claim 10, wherein the supplemental compressed-air flow is automatically raised or lowered as a function of a lowering or raising of the conveying-air flow.

12. Method as claimed in claim 3, wherein compensating compressed-air to compensate for pressure fluctuations in a powder suction line (46) connected to the vacuum zone (40) of the injector (26) is supplied to an end segment of the powder suction line located away from the injector (26) of the powder-suction line (46).

* * * * *